US005962393A

United States Patent [19]

Blum et al.

[11] Patent Number: 5,962,393

[45] Date of Patent: Oct. 5, 1999

[54] POWDERED ABRASIVE CLEANSER COMPRISING CALCIUM CARBONATE AND BORAX PENTAHYDRATE

[75] Inventors: Robert L. Blum, Concord; Denise A. Garner, Hayward; Carl M. Kling, Walnut Creek, all of Calif.

[73] Assignee: The Clorox Company, Oakland, Calif.

[21] Appl. No.: 08/748,652

[22] Filed: Nov. 14, 1996

[51] Int. Cl.[6] ..... C11D 3/14; C11D 3/10; C11D 9/16

[52] U.S. Cl. ..... 510/395; 510/199; 510/236; 510/460; 510/465; 510/486; 510/509; 510/139; 510/150

[58] Field of Search ..... 510/199, 236, 510/395, 460, 465, 486, 509, 139, 150

[56] References Cited

U.S. PATENT DOCUMENTS

| | | | |
|---|---|---|---|
| 3,309,319 | 3/1967 | Coward et al. . | |
| 3,530,071 | 9/1970 | Moore . | |
| 3,583,922 | 6/1971 | McClain et al. . | |
| 3,607,161 | 9/1971 | Monick | 51/307 |
| 3,882,034 | 5/1975 | Gibbons | 252/99 |
| 3,986,987 | 10/1976 | D'Souza | 3/65 |
| 4,005,027 | 1/1977 | Hartman | 252/95 |
| 4,021,360 | 5/1977 | McLaughlin et al. | 252/99 |
| 4,129,527 | 12/1978 | Clark et al. . | |
| 4,252,664 | 2/1981 | Inamorato | 252/99 |
| 4,297,229 | 10/1981 | Speak et al. | 252/109 |
| 4,308,182 | 12/1981 | Eckard et al. | 260/18 R |
| 4,526,698 | 7/1985 | Kuroda et al. | 252/99 |
| 4,751,016 | 6/1988 | Tse et al. . | |
| 4,788,005 | 11/1988 | Castro | 252/539 |
| 4,917,811 | 4/1990 | Foster et al. | 252/95 |
| 4,961,871 | 10/1990 | Michael | 252/174.11 |

*Primary Examiner*—Yogendra N. Gupta
*Assistant Examiner*—Charles Boyer
*Attorney, Agent, or Firm*—Burns, Doane, Swecker & Mathis, L.L.P.

[57] ABSTRACT

A powdered abrasive cleanser that exhibits superior soil removal properties and surface safety is provided. The cleanser includes a surfactant, an optional source of active chlorine, a borax pentahydrate compound that is preferably sodium tetraborate pentahydrate, and optionally an alkaline detergent builder and/or calcium carbonate.

15 Claims, No Drawings

POWDERED ABRASIVE CLEANSER COMPRISING CALCIUM CARBONATE AND BORAX PENTAHYDRATE

BACKGROUND OF THE INVENTION

1. Field of the Invention

The invention relates to powdered abrasive cleansers that exhibit superior soil removal properties and that are surface safe. The cleansers include an anionic, nonionic and/or amphoteric surfactant, borax pentahydrate, that is preferably sodium tetraborate pentahydrate, and optionally calcium carbonate, a source of active chlorine, and an alkaline detergent builder.

2. Brief Statement of the Related Art

Abrasive cleansers have long been in commercial use. These are typically dry powders incorporating silica sand, a source of hypochlorite and a nonionic or anionic surfactant. For instance, U.S. Pat. No. 3,530,071 discloses scouring cleansers containing chlorinated trisodium phosphate and a small critical amount of borax (sodium tetraborate decahydrate) which apparently stabilizes the chlorinated trisodium phosphate in storage but does not effect aluminum mark removal. U.S. Pat. No. 3,583,922 discloses a dry granular bleaching composition having allegedly improved effectiveness against food stains. The composition requires a combination of sulfamic acid and a source of available chlorine. Finally, U.S. Pat. No. 3,607,161 discloses a scouring composition comprising cationic surface active compounds and a water-soluble abrasive which may be borax pentahydrate. The composition purportedly leaves the surface which has been cleaned dry, shiny and free from a gritty residue film. Unfortunately, it has been found that the cationic surfactant is a fairly ineffective cleaning agent.

While prior art abrasive cleansers can effectively clean rough surfaces, such as concrete, their use is contraindicated on shiny or smooth surfaces, such as tiles or composite hard surfaces, such as ceramic, FORMICA® or CORIAN®, which can be dulled with use.

SUMMARY OF THE INVENTION

The present invention is based in part on the discovery that employing an abrasive blend comprising a specific combination of borax pentahydrate and calcium carbonate provides a powdered cleanser that exhibits superior soap scum and bathroom soil removal and good surface safety. The present invention is also based in part on the discovery that employing borax pentahydrate as the predominant, or essentially the sole, abrasive, provides a powder cleanser that exhibits exceptional surface safety.

In one aspect, the invention is directed to a surface safe, dry hard surface cleanser that includes:

a) an effective amount of a surfactant that is selected from the group consisting of anionic surfactants, nonionic surfactants, amphoteric surfactants, and mixtures thereof;

b) an effective amount of a borax compound having the formula $M_2B_4O_7 \cdot 5H_2O$, where M is an alkali metal selected from the group consisting of lithium, sodium, or potassium;

c) optionally, an effective amount of an alkaline detergent builder; and d) optionally, an effective amount of calcium carbonate, provided that when calcium carbonate is present, the mole ratio of calcium carbonate to the borax compound ranges from about 20:1 to about 1:1.

In preferred embodiments, the cleanser includes an effective amount of an alkaline detergent builder which functions as a chelating agent for hard water. In addition, when fragrances are employed, the alkaline detergent builders tend to absorb them and thereby function as a carrier for the fragrances. Further, a source of active chlorine is preferably present. In preferred embodiments, (1) surfactant is an anionic surfactant selected from the group consisting of alkyl benzene sulfonates, sodium lauryl sulfate, and mixtures thereof, (2) the source of active chlorine when present comprises sodium dichlororo-s-trazinetrione dihydrate, (3) the alkaline detergent builder comprises sodium carbonate, and/or (4) the borax is sodium tetraborate pentahydrate and the mole ratio of calcium carbonate to borax is about 12 to 1.

DETAILED DESCRIPTION OF THE PREFERRED EMBODIMENTS OF THE INVENTION

The invention provides an improved surface safe, powdered abrasive hard surface cleanser that includes effective amounts of (1) a surfactant, (2) a borax pentahydrate compound having the formula $M_2B_4O_7 \cdot 5H_2O$, where M is an alkali metal selected from the group consisting of lithium, sodium, or potassium, (3) optionally, a source of active chlorine, (4) optionally an alkaline detergent builder, and (5) optionally, calcium carbonate, wherein the mole ratio of calcium carbonate to the borax pentahydrate ranges from about 20:1 to about 1:1 when calcium carbonate is employed. Standard, additional adjuncts in small amounts such as pigments, dyes, opacifiers, fragrances, antimicrobial (mildewstat/bacteristat), and the like can be included to provide desirable attributes of such adjuncts.

In the specification, effective amounts are generally those amounts listed as the ranges or levels of ingredients in the descriptions which follow herein. All amounts listed as percentages are based on the weight percent of the cleanser composition.

1. Surfactants

As mentioned above, the surfactants are nonionic, anionic, amphoteric or mixtures thereof.

a. Anionic Surfactants

Suitable anionic surfactants selected, for example, from $C_{6-24}$ alkyl sulfates, $C_{6-24}$ alkylbenzene sulfonates, $C_{6-24}$ alkylsulfonates, $C_{6-24}$ secondary alkane sulfonates (paraffin sulfonates), $C_{6-24}$ iseothionates, $C_{6-24}$ alkylethersulfates, $C_{6-24}$ $\alpha$-olefin sulfonates, $C_{6-24}$ alkyl taurates, $C_{6-24}$ alkyl sarcosinates and the like. Each of these surfactants is generally available as the alkali metal, alkaline earth and ammonium salts thereof. The preferred anionic surfactant is, for example, a linear or branched $C_{6-16}$ alkylbenzene sulfonate, alkane sulfonate, alkyl sulfate, or generally, a sulfated or sulfonated $C_{6-16}$ surfactant. Preferred are the surfactants Pilot L-45, a $C_{11.5}$ alkylbenzene sulfonate (which are referred to as "LAS"), from Pilot Chemical Co., Biosoft S100 and S130 (non-neutralized linear alkylbenzene sulfonic acid, which is referred to as "HLAS") and S40 (neutralized) from Stepan Company. If the anionic surfactant is an acidic HLAS, such as BioSoft S100 or S130, it is neutralized in situ with an alkaline material such as NaOH, KOH, $K_2CO_3$ or $Na_2CO_3$, with more soluble salts being desirable. These acidic surfactants possess a higher actives level and can be cost-effective. Stepanol WAC is an example of a sodium lauryl sulfate (SLS), from Stepan Company.

Preferably, the cleanser employs anionic surfactants, and in one embodiment the surfactant consists essentially of an anionic surfactant. Cationic surfactants are, preferably, not employed because of their poor soil removal properties. In a preferred embodiment, the cleanser includes essentially no cationic surfactant.

b. Nonionic Surfactants

Suitable nonionic surfactants include, for example, the so-called semi-polar nonionic surfactants. These include trialkyl amine oxides, alkylamidoalkylenedialkylamine oxide, and sulfoxides.

The structure of the trialkyl amine oxide is shown below:

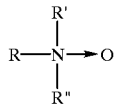

wherein R is $C_{6-24}$ alkyl, and R' and R" are both $C_{1-4}$ alkyl, although R' and R" do not have to be equal. These amine oxides can also be ethoxylated or propoxylated in the R long chain, or hydroxylated in the R',R" groups. The preferred amine oxide is lauryl amine oxide, such as Barlox 12, from Lonza Chemical Company.

The structure of the alkylamidoalkylenedialkylamine oxide is shown below:

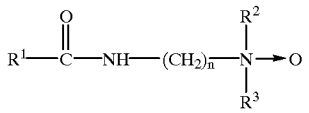

wherein $R^1$ is $C_{5-20}$ alkyl, $R^2$ and $R^3$ are $C_{1-14}$ alkyl,

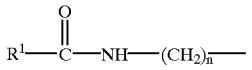

—or—$(CH_2)_p$—OH, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole). The preferred alkylamidoalkylenedialkylamine oxide is Barlox C, from Lonza Chemical Company.

Other nonionic surfactants can be chosen from, among others: Alfonic surfactants, sold by Conoco, such as Alfonic 1412-60, a $C_{12-14}$ ethoxylated alcohol with 7 moles of EO; Neodol surfactants, sold by Shell Chemical Company, such as Neodol 25-7, a $C_{12-15}$ ethoxylated alcohol with 7 moles of EO, Neodol 45-7, a $C_{,14-15}$ ethoxylated alcohol with 7 moles of EO, Neodol 23-5, a linear $C_{12-13}$ alcohol ethoxylate with 5 moles of EO, HLB of 10.7; Surfonic surfactants, also sold by Huntsman Chemical Company, such as Surfonic L12-6, a $C_{10-12}$ ethoxylated alcohol with 6 moles of EO and L24-7, a $C_{12-14}$ ethoxylated alcohol with 7 moles of EO; and Tergitol surfactants, both sold by Union Carbide, such as Tergitol 25-L-7, a $C_{12-15}$ ethoxylated alcohol with 7 moles of EO. Macol NP-6, an ethoxylated nonylphenol with 6 moles of EO, and an HLB of 10.8, Macol NP-9.5, an ethoxylated nonylphenol with about 11 moles of EO and an HLB of 14.2, Macol NP-9.5, an ethoxylated nonylphenol with about 9.5 moles EO and an HLB of 13.0, both from Mazer Chemical, Inc.; Triton N-101, an ethoxylated nonylphenol with 9–10 moles of ethylene oxide per mole of alcohol ("EO") having a hydrophile-lipophile balance ("HLB") of 13.4, Triton N-111, an ethoxylated nonylphenol with an HLB of 13.8, both from Rohm & Haas Co.; Igepal CO-530, with an HLB of 10.8, Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all polyethoxylated nonylphenols from GAF Chemicals Corp.; Alkasurf NP-6, with an HLB of 11.0, Alkasurf NP-15, with an HLB of 15, Alkasurf NP-12, with an HLB of 13.9, Alkasurf NP-11, with an HLB of 13.8, Alkasurf NP-10, with an HLB of 13.5, Alkasurf NP-9, with an HLB of 13.4, and Alkasurf NP-8, with an HLB of 12.0, all polyethoxylated nonylphenols from Alkaril Chemicals; and Surfonic N-60, with an HLB of 10.9, and Surfonic N-120, with an HLB of 14. 1, Surfonic N-102, with an HLB of 13.5, Surfonic N-100, with an HLB of 13.3, Surfonic N-95, with an HLB of 12.9, and Surfonic N-85, with an HLB of 12.4, all polyethoxylated nonylphenols from Huntsman. This latter group of nonionic surfactants may be classified as either: a) $C_{10-20}$ linear and branched alkoxylated alcohols, or b) $C_{10-20}$ alkoxylated alkylphenols. These alkoxylated alcohols include ethioxylated, propoxylated, and ethoxylated and propoxylated $C_{10-20}$ alcohols, with about 1–10 moles of ethylene oxide, or about 1–10 moles of propylene oxide, or 1–10 and 1–10 moles of ethylene oxide and propylene oxide, respectively, per mole of alcohol. Still other preferred surfactants include $C_{10-20}$ alkylether sulfates, such as the Steol line, namely, Steol CS460 and CS230, from Stepan Company. Alkanolamides, such as the Ninol series, 96-SL, are also desirable and also made by Stepan Company.

c. Amphoteric Surfactants

Amphoteric surfactants, such as an alkyl betaine or a sulfobetaine, can be employed particularly in place of the nonionic surfactant. Especially of interest are the alkylamidoalkyldialkylbetaines. These have the structure:

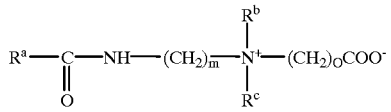

wherein $R^a$ is $C_{6-20}$ alkyl, $R^b$ and $R^c$ are both $C_{1-4}$ alkyl, although $R^b$ and $R^c$ do not have to be equal, and m can be 1–5, preferably 3, and o can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

Other suitable anionic and nonionic surfactants are described in U.S. Pat. Nos. 4,788,005, 4,751,016 and 4,129,527 which are incorporated herein. The surfactant generally comprises between about 0.25% to about 15%, preferably between about 0.5% to about 10%, and more preferably between about 1% to about 5% of the cleanser composition.

2. Optional Source of Active Chlorine

In some of the preferred embodiments of the invention, a source of active chlorine is included. The active chlorine source, when present, is used to oxidize stubborn stains and aids in disinfection of contaminated surfaces. Suitable compounds which provide a source of available chlorine include, for example, sodium dichloro-s-trazinetrione dihydrate, chlorinated trisodium orthophosphate, trichlorocyanuric acid, potassium and sodium dichlorocyanurate 5,5-dimethyl-1,3-dichlorohydantoin, sodium and potassium benzenesulfonchloramines, sodium and potassium para-toluenesulfonchloramines, sodium and potassium chloro bromo cyanurates, 1-chloro-3-bromo-5,5-dimethyl hydantoin, N-chloro succinimide, trichloro- and hexachloromelamines, calcium and magnesium hypochlorites, potassium, lithium, and sodium hypochlorites, and mixtures thereof. The preferred source is sodium dichloro-s-trazinetrione dihydrate.

The amount of source of active chlorine generally comprises between about 0% to about 5%, preferably between about 0.5% to about 2%, and more preferably between about 0.75% to about 1.5% of the cleanser composition.

3. Borax Compound

The inventive cleansers must include an abrasive that preferably (1) consists essentially of the borax pentahydrate or (2) is a blend of the borax pentahydrate and calcium carbonate. In either formulation, the total abrasive generally comprises between about 50% to about 92%, preferably between about 75% to about 90%, and more preferably between 82.5% to about 88% of the cleanser composition. The borax pentahydrate abrasive compound has the formula $M_2B_4O_7 \cdot 5H_2O$. The degree of hydration of the boron anion is important with respect to achieving good soil removal. Borax compounds having a degree of hydration of greater than about 5 are not expected to provide superior soil removal. The alkali metal M counterion is most preferably sodium, although lithium and potassium are both possible. Although the borax pentahydrate is readily soluble in water, the amount employed is typically greater than can be solubilized in the amount of water typically used in conjunction with powdered abrasive cleansers, therefore the borax pentahydrate which remains undissolved and suspended, acts as an abrasive for enhanced cleaning performance, especially of stubbornly adhering soils on smooth or glossy hard surfaces.

The sodium salt of borax pentahydrate has the formula $Na_2B_4O_7 \cdot 5H_2O$ and has properties analogous, but not identical, to borax decahydrate, more commonly known as "ordinary" borax. It is commercially available from North American Chemical Company, as V-Bor®, and U.S. Borax Inc. as Neobor®. The significant difference between the two products is that Neobor® has a larger particle size. In general, however, the preferred borax pentahydrate has a particle size such that the majority passes through a 20 U.S. Mesh sieve (~840$\mu$), but is retained by a 100 U.S. Mesh Sieve (~149$\mu$).

Borax pentahydrate also lends a desirable opacity to the inventive cleansers, yielding a very white, creamy appearance when water is added during cleaning. Most importantly, however, the use of the pentahydrate resulted in a superior surface safety performance, while providing superior cleaning performance. By "surface safety" is meant the attribute of minimal damage to a glossy or shiny hard surface, such as a plastic tile panel, as measured by reduction of gloss versus an uncleaned panel.

The borax pentahydrate generally comprises between about 5% to 100%, preferably between about 5% to about 50%, and more preferably between about 5% to about 15% of the total abrasive with calcium carbonate forming the remaining portion of the total abrasive. The amount of borax pentahydrate can vary, but is preferably present in an amount such that at least a partially undissolved part acting as an abrasive portion remains when water is added to the cleanser just prior to scrubbing. Typically, the borax pentahydrate can comprise up to about 90% of the cleanser composition.

4. Alkaline Detergent Builder

In cleaning a surface, the cleanser composition can be applied directly on the surface and water is then added before scrubbing. The alkaline detergent builder provides the proper pH when water is added. In addition, detergent builder enhances the detergency effect of the anionic surfactant and functions as a chelating agent and fragrance carrier. A preferred alkaline detergent builder is sodium carbonate and others include, for example, of water-soluble inorganic alkaline detergency builder salts such as alkali metal carbonates, phosphates, polyphosphates, and silicates. Specific examples of such salts are sodium and potassium tripolyphosphates, carbonates, pyrophosphates, phosphates, and hexametaphosphates.

Alkaline detergent builder may also include, organic alkaline sequestrant builder salts including, for example 1) alkali metal amino polycarboxylates (e.g., sodium and potassium ethylene diaminetetraacetates, N-(2-hydroxyethyl)-ethylene diamine triacetates, nitrilo triacetates, and N-(2-hydroxyethyl)-nitrilo diacetates); (2) alkali metal salts of phytic acid; (3) water-soluble salts of ethane-1-hydroxy-1,1-diphosphonate; (4) water-soluble salts of methylene diphosphonic acid (e.g., trisodium and tripotassium methylene diphosphonate; (5) water-soluble salts of substituted methylene diphosphonic acids (e.g., trisodium and tripotassium ethylidene, isopropylidene, benzylmethylidene, and halomethylidene diphosphonates), (6) water-soluble salts of polycarboxylate polymers and copolymers (e.g., polymers of itaconic acid, aconitic acid, maleic acid, mesaconic acid, fumaric acid, methylene malonic acid, and cinronic acid and copolymers with themselves and other compatible monomers such as ethylene).

Suitable alkaline detergent builders can also, include, for example, (1) aminopolyphosphonates, such as those commercially available under the trademark Dequest, from Monsanto Company, exemplary of which are Dequest 2000, 2041, 2060 and 2066 (See also Bossu, U.S. Pat. No. 4,473,507, column 12, line 63 through column 13, line 22, incorporated herein by reference), and (2) polyphosphonates, such as Dequest 2010, also from Monsanto Company, and (3) polyaminotetraacetates, such as Hampshire 1,3 PDTA, from W. R. Grace, and Chel DTPA 100#F from Ciba-Geigy A.G. Mixtures of the foregoing may be suitable.

The amount of alkaline detergent builder generally comprises between 0% to about 25%, preferably between about 2% to about 15%, and more preferably between about 5% to about 10% of the cleanser composition.

5. Calcium Carbonate

Calcium carbonate functions as an essentially water insoluble abrasive. Preferred cleaners include the calcium carbonate. It has been demonstrated, that superior soap scum and bathroom soil removal can be achieved when the cleanser composition includes the borax pentahydrate, in combination with calcium carbonate. In particular, a critical feature of the invention is that the mole ratio of the calcium carbonate to borax pentahydrate range from about 20:1 to about 1:1, more preferably from about 19:1 to about 1: 1, and most preferably about 12:1.

The calcium carbonate generally comprises between about 0% to about 95%, preferably between about 40% to about 85%, and more preferably between about 50% to about 75% of the total abrasive.

6. Miscellaneous Adjuncts

Small amounts of adjuncts can be added for improving cleaning and/or aesthetic qualities of the invention. Aesthetic adjuncts include fragrances, such as those available from Givaudan-Rohre, International Flavors and Fragrances, Firmenich, Norda, Bush Broke and Allen, Quest and others, and opacifying agents, pigments, dyes and colorants which can be solubilized or suspended in the formulation. A wide variety of opacifiers, pigments, dyes or colorants can be used to impart an aesthetically and commercially pleasing appearance. Speckles can also be added. An exemplary speckle may be produced according to the copending application Ser. No. 08/557,672, filed Nov. 8, 1995, entitled "Agglomerated Colorant Speckle Exhibiting Reduced Colorant Spotting", by Robert J. Iliff et al., which is incorporated herein. The amounts of these aesthetic adjuncts should be in the range of 0–2%, more preferably 0–1%. Additionally, it may be advantageous to add an antimicrobial compound, i.e., a mildewstat or bacteristat. Exemplary compounds include formaldehyde; phenol derivatives; Kathon GC, a 5-chloro-2-methyl-4-isothiazolin-3-one,Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boot Company Ltd.; Proxel CRL, a propyl-p-hydroxybenzoate, from ICI PLC; Nipasol M, an o-phenylphenol, $Na^+$salt, from Nipa Laboratories Ltd.; Dowicide A, a 1,2-benzoisothiazolin-3-one, and Dowicil 75, both from Dow Chemical Co.; and Irgasan DP 200, a 2,4,4'-trichloro-2-hydroxydiphenylether, from Ciba-Geigy A.G. See also, Lewis et al., U.S. Pat. No. 4,252,694 and U.S. Pat. No. 4,105,431, incorporated herein by reference.

Experimental

In the following experiments, the surprising performance benefits of the inventive cleanser are demonstrated. For these examples, borax pentahydrate refers to the sodium form.

EXAMPLE 1

Preparation of Baseline Formulation

Table 1 sets forth the baseline formulation used in preparing the inventive and some of the comparative cleansers tested. The balance of the composition comprised of moisture. Comparative commercially available powdered cleansers were used as is. As shown in Table 1, when preparing the cleansers sufficient amount of abrasive(s) (component 1) is added to the baseline formulation so that the total abrasive constitutes approximately 88% of the cleanser. Although the inventive cleansers are formulated in dry powdered form, there will be some moisture incorporated from the atmosphere. Preferably the amount of water present is less than about 5%.

TABLE 1

| | Components | Weight % As-Is | Weight % As Active |
|---|---|---|---|
| 1. | Abrasive | 88.% | 88.% |
| 2. | Lauryl benzene sulfonate[1] | 0.63% | 0.25% |
| 3. | Sodium lauryl sulfate[2] | 0.81% | 0.75% |
| 4. | Sodium dichloro-s-triazinetrione dihydrate[3] | 0.91% | 0.90% |
| 5. | Sodium carbonate[4] | 8.70% | 8.70% |

[1]Available as Nacconol LAS (40% active) from Stepan Co.
[2]Available as Stepanol ME-Dry SLS (93% active) from Stepan Co.
[3]Available as ACL 56 (granular) bleach (99% active) from Oxychem
[4]Available from FMC In the following examples, surface safety performance and bathroom soil removal performance of the inventive and comparative formulations were observed. The following testing protocols were utilized:

Bathroom Soil Removal Protocol

In Examples 2–4, soap scum and bathroom soil removal on white ceramic tile was measured using, as a testing apparatus, a Minolta proprietary device, which measures the integrated areas under a cleaning profile curve, which is the cumulative amount of soil removed at each cycle, with a maximum of 50 cycles. Thus, a maximum score of 5,000 can theoretically be achieved. In any case, in this test, the higher the score achieved is more preferred. Each cleanser was applied to a sponge as a paste (3:2 product to water ratio).

Surface Safety Test Protocol

In Example 5, the effect that an abrasive has upon a surface was measured by calculating the change in light reflectance occurring after the application and use of a product on a new, black acrylic tile. This was achieved by using a Minolta 268 Refractometer (set at a 20° geometry) to measure the change in gloss after scrubbing by the Gardner Wear Tester. Three grams of product was evenly applied every 25 cycles to a clean sponge and operated under 1000 grams of weight. The final gloss measurement was taken after 100 cycles. In this test, the lower the score the less surface damage.

EXAMPLE 2

Effect of Abrasive on Soil Removal

In this test, several abrasive compounds were screened for soil removal effectiveness when substituted into the baseline formulation. Both water-insoluble and water-soluble abrasives were evaluated. As is evident, from the results set forth in Table 2, the formulation containing borax pentahydrate (a slightly water-soluble compound) demonstrated superior soil removal as compared to formulations containing a water-insoluble or water-soluble abrasive. Further, the hydration level of the borax anion had a significant impact on soil removal performance, as borax pentahydrate produced a better cleanser composition than borax decahydrate.

TABLE 2

| Abrasive added to Baseline Formulation | (Area) Soap Scum | (Area) Bathroom Soil |
|---|---|---|
| Borax Pentahydrate | 4,291 | 3,892 |
| Borax Decahydrate (sieve 30/70) | 2,901 | 3,741 |
| Borax Decahydrate (sieve 40/200) | 2,253 | 2,923 |
| Borax Decahydrate (Powder) | 2,620 | 3,363 |
| Calcium Carbonate #8 | 3,878 | 3,916 |
| Calcium Carbonate #10 | 3,539 | 3,809 |
| Sodium Bicarbonate | 3,048 | 2,503 |
| Calcium Sulfate | 2,289 | 3,745 |
| Comet ™[1] (used as is) | 3,318 | 3,693 |

[1]Powder cleanser available from Procter & Gamble.

EXAMPLE 3

Effect of Borax Calcium Carbonate Ratio on Soil Removal Performance

In this test, compositions prepared by adding mixtures of abrasives were tested. As is evident from the results set forth in Table 3, formulations containing a mixture of borax pentahydrate and calcium carbonate showed superior soil removal as compared to formulations containing only calcium carbonate or only borax pentahydrate. Additionally, a synergistic effect with respect to soil removal performance was observed by combining calcium carbonate (water-insoluble abrasive) with borax pentahydrate (slightly water-soluble). For soil removal performance a ratio (wt:wt) of about 1:1 to about 3:1 borax pentahydrate to calcium carbonate is preferred.

TABLE 3

| Abrasives added to Baseline Formulation (Ratio expressed as wt %/wt %) | (Area) Soap Scum | (Area) Bathroom Soil |
|---|---|---|
| 100% Calcium Carbonate | 3,136 | 4,083 |
| 1:3 Borax Penta/Calcium Carbonate | 3,775 | 4,291 |
| 1:1 Borax Penta/Calcium Carbonate | 4,030 | 4,338 |
| 3:1 Borax Penta/Calcium Carbonate | 4,031 | 4,373 |
| 100% Borax Pentahydrate | 3,672 | 4,023 |
| Comet ™ (used as is) | 2,877 | 3,855 |

EXAMPLE 4

Soil Removal of Inventive Cleanser Versus Commercial Cleansers

In this test, an inventive composition containing about 75.66% calcium carbonate and 13.3% borax pentahydrate (as the abrasive blend that is added to the baseline formulation) was compared to several leading powder cleansers which contain calcium carbonate as the sole abrasive. As shown by the results in Table 4, the inventive cleanser was superior.

TABLE 4

| Products | (Area) Soap Scum | (Area) Bathroom Soil |
|---|---|---|
| Inventive cleanser | 3,597 | 4,089 |
| Comet ™ | 2,999 | 3,859 |
| Ajax ™[1] | 2,778 | 3,747 |
| Bon Ami ™[2] | 2,903 | 3,996 |

[1]Available from Colgate Palmolive
[2]Available from Fault Starch Bon Ami Co.

EXAMPLE 5

Effect of Abrasive on Surface Safety

For this test, several abrasive compounds were screened for their surface safety effectiveness when substituted into the baseline formulation. As is apparent from the data in Table 5, cleanser compositions containing borax pentahydrate or decahydrate exhibited superior surface safety as compared to compositions containing calcium carbonate. In addition, the borax containing compositions demonstrated improved rinsability relative to conventional abrasive cleansers, as very little residue remained after the tiles were wiped with a cloth.

In another set of experiments, the results of which are not set forth in Table 5, it was demonstrated that for cleansing compositions containing a borax compound and calcium carbonate blend, the level of surface safety decreased as the relative amount of calcium carbonate increased. Thus, while the data set forth in Table 3 show that abrasive blends containing borax pentahydrate and calcium carbonate produced surprisingly superior soil removal capabilities, these same formulations did not demonstrate surface safety comparable to those of cleansing compositions wherein the abrasive consisted essentially of borax pentahydrate. Therefore, to provide improved surface safety over conventional abrasive cleansers, the abrasive system should be comprised predominately or essentially of borax pentahydrate. Surprisingly, when the abrasive consisted essentially of borax pentahydrate, superior soil removal performance relative to conventional water-insoluble formulas was achieved, while providing superior surface safety.

TABLE 5

| Abrasive added to Baseline Formulation | Surface Safety Change in Glossmeter Units |
|---|---|
| Borax Pentahydrate | 1.3 |
| Borax Decahydrate (sieve 30/70) | 1.9 |
| Borax Decahydrate (sieve 40/200) | 3.4 |
| Borax Decahydrate (Powder) | 0.3 |
| Calcium Carbonate #8 | 40.2 |
| Calcium Carbonate #10 | 34.5 |
| Sodium Bicarbonate | 2.0 |
| Calcium Sulfate | 7.8 |
| Comet ™ (used as is) | 44.3 |

The foregoing has described the principles, preferred embodiments, and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of the present invention as defined by the following claims.

What is claimed is:

1. A surface safe, dry hard surface cleanser comprising:

a) about 1% to about 5% of a surfactant that is selected from the group consisting of anionic surfactants, nonionic surfactants, amphoteric surfactants, and mixtures thereof;

b) an abrasive effective amount of a borax pentahydrate compound having the formula $M_2B_4O_7 \cdot 5H_2O$, where M is an alkali metal selected from the group consisting of lithium, sodium, potassium, or mixtures thereof;

c) about 5% to about 10% of an alkaline detergent builder and;

d) an abrasive effective amount of calcium carbonate, wherein the mole ratio of calcium carbonate to the borax pentahydrate compound ranges from about 20:1 to about 1:1.

2. The cleanser of claim 1, wherein M is sodium.

3. The cleanser of claim 1, wherein the surfactant does not include a cationic surfactant.

4. The cleanser of claim 1 further comprising e) a stain oxidizing effective amount of a source of active chlorine.

5. The cleanser of claim 4, wherein the source of active chlorine comprises about 0.75% to about 1.5% of the cleanser.

6. The cleanser of claim 1, wherein the calcium carbonate and borax pentahydrate compound comprises up to about 92% of the cleanser.

7. The cleanser of claim 1, wherein the calcium carbonate comprises from about 75% to about 88% of the cleanser.

8. The cleanser of claim 1, wherein the surfactant is an anionic surfactant selected from the group consisting of alkyl benzene sulfonates, sodium lauryl sulfate, and mixtures thereof.

9. The cleanser of claim 4, wherein the source of active chlorine comprises sodium dichlororo-s-trazinetrione dihydrate.

10. The cleanser of claim 1, wherein the alkaline detergent builder comprises sodium carbonate.

11. The cleanser of claim 1, wherein the mole ratio of calcium carbonate to borax pentathydrate is about 12 to 1.

12. The cleanser of claim 1, further comprising adjuvants selected from the group consisting of dyes, pigments, fragrances, preservative and mixtures thereof.

13. A method for the essentially non-damaging cleaning of a surface comprising:

applying an aqueous mixture comprising the cleanser of claim 1 to said hard surface.

14. The cleanser of claim 13, wherein M is sodium.

15. The method of claim 13, wherein said surface is manufactured from man-made materials.

* * * * *